US006170705B1

(12) United States Patent
Schneider et al.

(10) Patent No.: US 6,170,705 B1
(45) Date of Patent: Jan. 9, 2001

(54) DOUBLE-WALLED TUBE WITH OUTER METAL SHELL AND INNER PLASTIC SHEATH

(75) Inventors: Bernard Schneider, Sainte Menehould; Hervé Bodet, Verdun, both of (FR)

(73) Assignee: Cebal SA, Clichy (FR)

( * ) Notice: Under 35 U.S.C. 154(b), the term of this patent shall be extended for 0 days.

(21) Appl. No.: 09/367,047

(22) PCT Filed: Mar. 4, 1998

(86) PCT No.: PCT/FR98/00427

§ 371 Date: Aug. 6, 1999

§ 102(e) Date: Aug. 6, 1999

(87) PCT Pub. No.: WO98/40283

PCT Pub. Date: Sep. 17, 1998

(30) Foreign Application Priority Data

Mar. 7, 1997 (FR) ..... 97 02957

(51) Int. Cl.[7] ..... B65D 35/00; B65D 35/14

(52) U.S. Cl. ..... 222/92; 222/107; 222/569

(58) Field of Search ..... 222/566, 567, 222/569, 92, 107

(56) References Cited

FOREIGN PATENT DOCUMENTS

| | | |
|---|---|---|
| 295 02 931 U | 4/1995 | (DE) . |
| 89 141 | 8/1967 | (FR) . |
| 2 322 058 | 3/1977 | (FR) . |

*Primary Examiner*—Kevin Shaver
*Assistant Examiner*—David Deal
(74) *Attorney, Agent, or Firm*—Pollock, Vande Sande & Amernick, R.L.L.P.

(57) ABSTRACT

The invention concerns a double-walled tube (1) for storing and dispensing hazardous products, comprising an inner tube (10) with a skirt (13), a shoulder (12) and an inner neck (11) delimiting an inner orifice (14), a metal tube with a skirt (25), a shoulder (24) and an outer neck (21), the two tubes being mutually connected at their necks (11 and 21) by a joining piece (30) comprising a bottom (34) and at least an outer skirt (35) enclosing the two necks (11 and 21). The invention is characterised in that the joining piece (30) is provided with an inner skirt (31) with its outer wall having a globally truncated profile, such that, when the joining piece (30) is forcefully pushed down, said inner skirt (31) causes the median parts of the necks (11 and 21) to expand at their circumference, thus widening the ends of said necks.

13 Claims, 1 Drawing Sheet

DOUBLE-WALLED TUBE WITH OUTER METAL SHELL AND INNER PLASTIC SHEATH

FIELD OF THE INVENTION

The present invention relates to a double-walled tube constituted by an outer metal envelope and a protective, flexible inner envelope intended to store and dispense detergent products, hygiene products or cosmetic products, such as hair dyes, that are particularly corrosive to the outer metal envelope.

BACKGROUND ART

Metal tubes are appreciated for their high restitution rate. Also the perfect plasticity of the metal prevents any of the product returning inside the tube when the operator has finished pressing the skirt of the tube. On the other hand, the metal tube is subjected to corrosion when it contains particularly acidic or alkaline products.

Attempts consisting in coating the inner surface of metal tubes with varnish have proved unsuccessful: the deposited coat is never very regular, it holds more or less well onto the surface, it is fragile and cracks after the tube has been used a number of times. Cracks appear through which the product passes and eventually corrodes the metal. Also, the ends of the tube, i.e. the neck at one end and the open end at the other through which the tube is filled and that is then flattened and folded to seal the tube, are not protected or are insufficiently protected by the varnish.

French patent application 2 322 058 discloses a double-walled tube constituted by two separate tubes that are connected at the necks. The metal tube constitutes an outer envelope that is protected from the corrosive product by a plastic inner tube. The top end of the neck of the inner plastic tube projects far beyond the top of the neck of the external metal tube. The projected section flares out in a trumpet shape above the metal neck and is then embedded into a plastic end molded above and around the metal neck. Three separate operations are required to produce a tube of this kind: the insertion of the inner tube into the outer tube, the flaring of the projected end of the neck of the inner tube and then the difficult molding of a plastic collar onto the edge of the outer metal neck.

Patent application J07277349 describes a double-walled tube that is also constituted by two separate tubes but that are connected together at the neck by a nozzle that is tightly threaded around the assembly. As in French patent application 2 322 058, the top end of the neck of the inner tube projects well beyond the top end of the outer metal tube. The projecting section is flared and then folded outwards covering the outer metal neck. The nozzle is tightly threaded and bears on the folded section of the inner tube. In order to ensure that the connection is leaktight J07277349 recommends that at least one surface of the ends of the inner tube, which is made of plastic, has a smooth surface without a mold joint line. A smooth surface of this kind is achieved by injection-molding the inner tube.

The end of the neck of the inner plastic tube must be thin enough in order for it to be folded over the top end of the neck and to cover the lateral outer surface of the metal neck. The thinness of the inner plastic tube means that it is prone to buckling and it does not facilitate the first shaping stage in which the neck is flared. This essential stage is complicated by the need to design tooling to hold the neck steady when it is flared. Also, with large capacity tubes that must have a skirt length of over 130 millimeters injection-molding cannot easily be used to produce a thin, plastic neck able to withstand cracking under strain. These tubes require materials to be used that are suitable for being injected in a long, narrow air gap. Materials of this kind must have a high melt index that is higher than 15 and they are much more prone to cracking under strain when they are brought into contact with the contained product than the materials generally used with a much lower melt index (0.2 to 2).

Also, it would be preferable to produce the inner plastic tube using other, more economical, means, for example using extrusion blow-molding or by molding a head onto an extruded or welded laminated skirt. In order to achieve this, the need to have an outer surface without any protrusions, such as a molding joint line, would have to be set aside, as would the need to obtain a neck shape that could be series-produced. Both these conditions are necessary in J07277349 in order to obtain complete leaktightness of the connection between the necks.

PROBLEM POSED

Therefore, the applicant has attempted to produce a double-walled tube constituted by a protective, flexible inner envelope and an outer metal envelope intended to store and dispense products that are corrosive to the outer metal envelope, the two envelopes being connected together at the ends, the connection at the necks having improved leaktightness, particularly for long tubes.

DISCLOSURE OF THE INVENTION

A first aim of the invention relates to a double-walled tube comprising an internal tube having a skirt, a shoulder and a neck hereafter called "inner neck" that defines an opening hereafter called "inner opening", a metal tube having a skirt, a shoulder and a neck hereafter called "outer neck", provided with snap-on means on the outer wall, the two tubes being connected together at the neck by a nozzle that comprises a base and at least one outer skirt that grips said two necks and that is provided with additional snap-on means to the snap-on means of the outer neck, characterized in that the nozzle is provided with an inner skirt the outer surface of which has an overall tapered profile such that when the nozzle is forced downward said inner skirt causes the circumferences of the central parts of the neck to expand and the ends of said necks to flare.

When the nozzle is forced downward the base of the nozzle is not brought to bear on the edges of the inner and outer necks. In other words, significant play, greater than some tenths of a millimeter, exists between the base of the nozzle and said edges. The outer diameter of the section of the inner skirt of the nozzle that is inserted into the inner neck is greater than the initial diameter of the inner opening of the inner opening over a length that is at least equal to 2 millimeters.

The inner tube can be made of any flexible substance capable of protecting the outer metal envelope from any corrosive product contained within. Preferably, the inner tube is plastic. It is obtained using any known means such as injection molding, extrusion blow-molding, molding the head then welding it onto an extruded or welded laminated skirt. The neck is not provided with hollow or protruding features but may comprise mold joint lines. The neck is sufficiently thick to avoid becoming buckled when the nozzle is depressed on the necks. The shape of this cylindrical, hollow neck should preferably have a height and thickness relation lower than 10 in order to avoid concertina-type distortion of said neck.

The outer tube is metal. It comprises a skirt, a shoulder and a neck. The inner tube is inserted in the outer tube before the nozzle is depressed. Given that the outer diameter of the inner neck is more or less equal to or very slightly less than the inner diameter of the outer neck the two necks are very close to each other at a certain height that is common to their outer and inner surfaces respectively. The inner neck does not project beyond, or only very slightly beyond, the outer neck: it is not necessary for it to be folded over the end of the outer neck.

The outer appearance of the nozzle resembles nozzles of the prior art. It may be provided with an outer skirt that has means, on the outer surface, for connecting it to a stopper, for example that is threaded. It is firmly held in place covering the outer neck by fastening means such as snap-on flanges that are located respectively on the outer surface of the outer neck and on the inner surface of the outer skirt of the nozzle. If the tube is intended to be sealed by a cap or a stopper being screwed into the outer surface of the nozzle the outer skirt is provided with a thread on the outer surface and the inner surface, that is already provided with a snap-on flange, is also provided with anti-rotation means such as longitudinal ribs. As the nozzle is depressed, these means, that are also longitudinal ribs with matching cross-sections located, for example, on the outer surface of the outer neck, are inserted between the anti-rotation means. The nozzle is pre-centered in order to facilitate the anti-rotation means being inserted. The pre-centering is facilitated by the presence of the inner skirt and the upper ends of the ribs of the outer neck and the lower ends of the ribs of the outer skirt of the nozzle which are threaded. Patent application EP 0 119 145 has already suggested several shapes and sets of ribs that facilitate the self-centering of a part that is to be threaded around another part.

The base of the nozzle lies at a distance from the snap-on flange, that is located on the inner surface of the outer skirt of the nozzle, such that when the nozzle is depressed to the maximum position the inner surface of said nozzle base is not brought to crush the flared ends of the necks. Therefore, the base of the nozzle is not brought to bear on any of the neck edges.

The inner skirt of the nozzle may be forced downward inside the inner opening, the outer diameter of the of the orthogonal sections of said inner skirt being partly in contact with the inner neck along a section at least 2 millimeters long, said diameter being greater than the initial diameter of the inner opening, i.e. the diameter of the inner opening before the nozzle was depressed. The applicant has ascertained that this minimum length must exist whatever the outer diameter of the intended neck, usually between 4 and 25 millimeters.

The inner tube is held firmly fastened inside the outer tube due to there being no pressure on the edges of the neck, particularly on the edge of the inner neck, and there being a sufficiently long friction surface. This fastening is further improved by the ends of the necks being flared.

The outer surface of the inner skirt has an overall tapered profile, the open end of the skirt being directed towards the apex of the cone such that when the inner skirt is forced downward inside the inner opening the inner skirt causes plastic distortion that results in the ends of the two necks becoming flared. Therefore, the inner skirt of the nozzle has two functions: firstly, when the nozzle is forced downward it acts as tooling that causes circumferential expansion of the central parts of the necks, the inner neck that is in direct contact with the skirt being under greater strain and that then causes the ends of the necks to flare. It is also a leaktight skirt that is effective throughout the service-life of the tube.

The inner neck, which is in direct contact with the inner skirt of the nozzle, is subjected to circumferential expansion distortion and the outer surface is brought into contact with the inner surface of the outer neck by transmitting radial forces directed outwards. This ensures even closer contact between these two surfaces as the outer neck is less likely to become distorted than the inner neck, in other words the outer neck remains stiffer and harder than the inner neck. This produces a perfectly leaktight connection even if the outer surface of the inner skirt is not perfectly smooth, for example due to a mold joint line.

The inner skirt of the nozzle is preferably thicker near the fastenings in order to withstand the strain to which it is subject when the nozzle is forced downward. One preferred version of the invention consists in providing the inner skirt of the nozzle with a cylindrical inner surface and an axi-symmetrical outer surface that is partly cylindrical and partly truncated cone-shaped, the central part being cylindrical, the two other sections being tapered.

Preferably, the outer surface of the inner skirt of the nozzle comprises three sections of more or less equal measurements that can be described, working from the base upwards, as follows:

- a first tapered section with a half angle at the top between 5 and 20°, the apex of which lies in the direction of the open end;
- a second cylindrical section with a circular cross-section the diameter of which is greater than the initial diameter of the inner opening, i.e. greater than the diameter of the opening constituted by the inner neck before the nozzle is depressed;
- a third tapered section with a half angle at the top between 5 and 20°, the apex of which lies in the direction of the open end.

When the nozzle is forced downward into the necks, this shape causes said necks to be subjected to different types of expansion according to the sections concerned:

- major circumferential expansion near the skirt fastener on the base of the nozzle: the shapes of the two ends of the necks are distorted, i.e. they have been subjected to irreversible flaring. The angle of the tapered surface must therefore be wide enough (>5°) to cause the two necks to become significantly distorted but must remain narrow enough (<20°) in order to avoid excess strain or tearing. Advantageously, the end of the outer neck is subjected to limited expansion by being brought to bear on the inner surface of the outer skirt of the nozzle, thus enabling an airtight contact to be maintained between the ends of the two necks;
- a relatively high level of circumferential expansion in the middle of the skirt; the neck sections concerned, at a distance from the ends, are more restricted in their distortion. The inner neck is tightly compressed between the inner skirt of the nozzle and the outer neck, both of which are stiffer, to become thinner in this central part than at the flared end. The inner neck section in question is therefore "strangled", which, with the friction on the surfaces, causes the inner tube to be retained within the outer tube.
- slight to non-existent expansion; the tapered section of the outer surface of the inner skirt of the nozzle facilitates positioning of said nozzle above the necks and prevents concertina-type distortion of the inner neck.

In order to improve leaktightness, the end of the outer metal neck is distorted such that it is brought to bear on the inner surface of the nozzle. Contact is therefore maintained with the two distorted ends of the neck between the base of the inner skirt and the end of the outer skirt of the nozzle. In order to facilitate the end of the outer neck being brought to stop against the outer skirt of the sleeve, the base of said skirt is thick and the inner surface is smooth. The inner diameter is more or less equal to the outer diameter of the outer neck increased by a lower value of the difference between the diameter of the cylindrical section of the inner skirt of the nozzle and the initial diameter of the inner opening.

The inner neck is relatively thick, thus reducing the effect of possible localized over-thickness of the outer surface on the gripping and leaktight qualities. Compared to the simple nozzles of the prior art, the nozzle of the invention has the advantage of locating the leaktight contact on the first diameter with which the product is brought into contact. There is no risk of the product being retained in the peripheral areas that are more or less under strain when the tube is used. Also, the close contact is located on the smallest diameter that, therefore, obtains tighter and more efficient gripping for a given difference of diameter.

Preferably, the nozzle is made of a substance that is harder and stiffer than that of the inner tube and that is also less hard and less stiff than that of the outer tube. A solution that provides satisfactory results is one in which the nozzle is made of polypropylene (PP), the outer tube of annealed aluminum and the inner tube of low-density polyethylene (LD.PE).

The inner skirt of the nozzle must be thin enough to leave an opening suitable for dispensing the product and thick enough to cause the two necks to distort as intended. The inner skirt must also be able to mechanically withstand the strain created when the nozzle is forced downward and that continues after the operation while remaining flexible throughout the service-life of the tube. Preferably, the skirt consists of a single part that includes the nozzle, for example molded in stiff plastic such as polypropylene. The aluminum outer tube is completely annealed after it has been shaped which provides the tube with a certain degree of flexibility in the thin areas. The inner tube is made of a substance that is as flexible and the least hard as possible in order to resist cracking under strain when subjected to a corrosive agent, such as hair dye. Preferably, the inner tube is made of plastic, such as low-density polyethylene. The head is molded separately and is fastened onto an extruded or welded laminated skirt. These two operations may be achieved at the same time using cast-molding and they enable different plastics to be chosen for the head and for the skirt providing that both are capable of chemically withstanding the product that the tube is intended to contain.

The applicant experimented with different shapes, particularly varying the diameters and thicknesses of the necks and skirts of the nozzle after choosing the respective substances for the tubes and the nozzle according to the products to be processed. The highest levels of leaktightness were achieved using an inner neck that is approximately the same thickness as the cylindrical section of the inner skirt of the nozzle. The outer neck may be thinner than the other two as the metal is far stiffer. The top end of the outer neck may be even thinner, generally thinned to as much as half the thickness of the inner neck such that it is capable of flaring easily. This facilitates the flaring of the inner neck as the flared section remains thicker than the central part of the neck. Therefore, the central part of the inner neck is gripped between a flared end that is not thinned or only slightly thinned and a undistorted base. This gripped position is used to hold the inner tube firmly inside outer tube.

When the device is assembled the inner skirt of the nozzle causes distortion that results in a degree of gripping between 3 and 8%, preferably between 4 and 6%, i.e. the outer diameter of the cylindrical section of the of the inner skirt of the nozzle is approximately 5% greater than the initial diameter of the inner opening. Looser gripping does not provide a satisfactory degree of leaktightness throughout the entire service-life. Certain loosening, at a higher or lower degree depending on the original gripping, is ascertained after a few weeks at ambient temperature. Tighter gripping either causes concertina-type distortion of the inner tube when the nozzle is depressed on the necks or insufficient depression that results in assembly being impossible if the inner neck is relatively thick.

A second aim of the invention concerns the nozzle itself that comprises a base and an outer skirt provided with snap-on and anti-rotation means, characterized in that it comprises an inner skirt, also fastened to the base, the outer surface of which has an overall tapered profile, the open end of the skirt being directed towards the apex of the cone. Preferably, this inner skirt is thicker near the fastening on the base of the nozzle. Advantageously, the skirt comprises a cylindrical inner surface and a partly cylindrical, partly truncated conical outer surface, the tapered and cylindrical sections being approximately the same height, the tapered sections forming a half angle between 5 and 20° at the top. Preferably, this nozzle is made of a hard plastic, such as polypropylene.

Other characteristics, aims and advantages of the present invention will be better understood from the following detailed description. The description is of a non-limitative example and refers to the attached figures where:

TUBE ACCORDING TO THE INVENTION (FIG. 1 AND FIG. 2)

Figure 1:
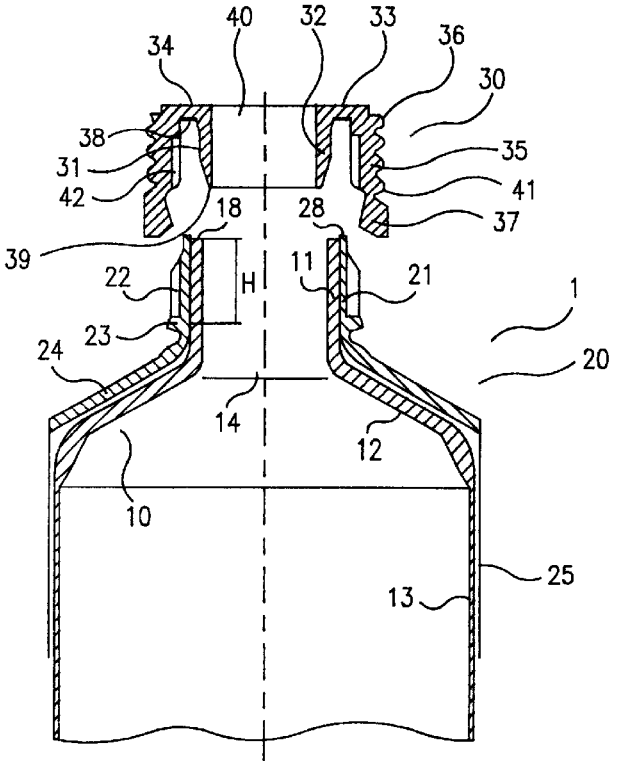
FIG. 1 shows an axial cross-section of a double-walled tube head according to the invention onto which the nozzle is assembled before being forced downward on the inner and outer necks.

The double walled tube 1 comprises an inner tube 10 and an outer tube 20 made of annealed aluminum. The inner tube 10 is obtained by molding a head 12 made of LD.PE (low-density polyethylene) onto a skirt 13, also made of polyethylene, with a 24.3 mm diameter and that is 250 microns thick. The inner neck 11 contains an inner opening 14. The top end of the neck is edge 18. The outer tube 20, made of annealed aluminum, has a skirt 25 with a 25 mm outer diameter and that is 120 microns thick. The outer tube has a shoulder 24 and a neck 21 the top end of which is edge 28.

The measurements of the outer diameter of inner neck 11 and the inner diameter of outer neck 21 are equal: 8.7 mm. The inner neck 11 is 0.75 mm thick. The outer neck 21, that is 0.5 mm thick, is provided with a snap-on flange 23 on the outer surface located at the base of the neck and the longitudinal ribs 22 that extend the length of said outer wall to 1 mm from the end. Inner tube 10 is inserted in the aluminum outer tube using standard means: a mandrel is inserted inside the inner tube and draws the inner tube inside the outer tube, the shoulder and the head of which are immobilized by tooling that is shaped to fit the outer shape. Once inserted, edge 18 of inner neck 11 projects several tenths of a millimeter beyond edge 28 of outer neck 21. The outer neck and the inner neck have a common contact height H along approximately 4.7 mm.

After necks 11 and 21 of the two tubes 10 and 20 have been brought into contact with each other nozzle 30 is forced downward, inner tube 10 still being held on the mandrel.

Nozzle 30 has an inner skirt 31, a base 34 and an outer skirt 35 provided on the inner surface, ribs 42 that operate in conjunction with ribs 22 of outer tube 20 and are intended to prevent the rotation of nozzle 30 and, on the outer surface, a thread 41 used to screw on a cap intended to seal the dispensing opening 40. The cylindrical section 32 of inner skirt 31 has a 7.5 mm diameter that requires a 0.3 mm grip when nozzle 30 is depressed on necks 11 and 21. The effect of a certain flow will be felt after a few days that causes permanent distortion of the two necks and a loosened grip, said grip remaining, however, greater than 0.1 mm.

Inner skirt 31 of nozzle 30 has an inner cylindrical surface that contains a circular dispensing opening 40 with a 6.1 mm diameter and a partly cylindrical, partly truncated cone-shaped outer surface, the trunks of the cone having their apex, i.e. the tops of the cones on which they bear, in the same direction as open end 39 of skirt 31. This surface, with a 4 mm height between inner surface 38 of base 34 and open end 39, is separated into three areas:

- a 1.5 mm high cylindrical central area 0.75 mm thick,
- a 1 mm high, tapered fastening area that widens out to 8 mm diameter at fastener 33 on base 34 of nozzle 30. The half angle of the cone trunk is approximately 12°,
- a 1.5 mm high tapered end area with a 15° half angle.

The outer skirt 35 of nozzle 30 has a thick section 36, next to the fastener, the smooth inner surface of which with a 9.8 mm diameter is not brought to stop against the anti-rotation ribs 22 of the outer neck.

When nozzle 30 is depressed ribs 42 are inserted in the spaces left by ribs 22 of outer neck 21, cylindrical section 32 of inner skirt 31 of nozzle 30 causes the necks to expand by 0.3 mm, then tapered section 33 near the fastener of base 34 of nozzle 30 causes all the ends of necks 11 and 21 to expand. The outer neck 21, of outer diameter 9.7 mm, flares 0.1 mm outwards and is then brought to bear on this smooth section of the inner surface of outer skirt 35 of nozzle 30.

The outer skirt 35 of nozzle 30 is also provided with a snap-on flange 37 towards the open end. The position of this snap-on flange 37 relative to base 34 of nozzle 30 is chosen such that at the end of the snap-on stage inner surface 38 of base 34 of nozzle 30 does not bear on the top, flared ends of necks 11 and 21. This position is also such that the beginning of the flaring occurs before the beginning of the snap-on stage, which reduces the strain needed to depress the nozzle.

Figure 2:
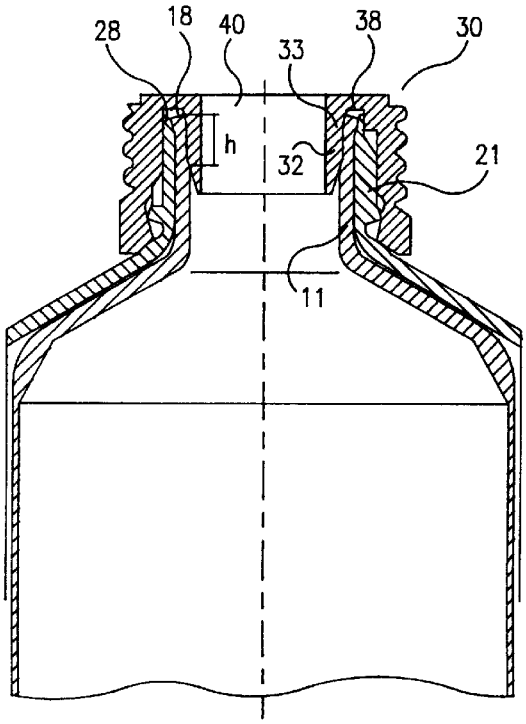
FIG. 2 shows the head of a double-walled tube according to the invention after the nozzle has been forced downward on the necks. The left-hand side is a axial cross-section along a diametric plane passing through a longitudinal rib of the nozzle, the righthand side is a axial cross-section along a diametric plane passing through a longitudinal rib of the outer neck.

FIG. 2 shows that after nozzle 30 has been forced downward, inner surface 38 of base 34 of nozzle 31 does not bear either on edge 18 of inner neck 11 nor on edge 28 of outer neck 21. Also, the section of inner skirt 31 of nozzle 30, that has a larger diameter than the diameter of inner opening 14, affects the necks along a height h of approximately 2.6 mm, i.e. a little more than half the contact height H common to both necks.

Leaktightness Test

Approximately fifty double-walled tubes made according to this version of the invention were tested. The test consists in injecting air inside the tubes until 500 g/cm$^2$ pressurization was reached. These tubes were then sealed and held under water for 30 seconds. No leaks were detected.

Advantages

Facilitates assembly of inner tube and outer tube heads by not requiring the end of the inner neck to be folded over the end of the outer neck;

The inner tube can be made using any method, the outer surface not having to be perfectly smooth in order for a high level of leaktightness to be achieved;

Does not require the inner tube, outer tube or the nozzle to be made to extremely accurate tolerances;

Possibility of creating the inner tube by molding on to a skirt; the head and the skirt of the inner tube can be made of different substances that must, however, be compatible when melted together.

What is claimed is:

1. Double-walled tube (1) intended to store and dispense corrosive products, comprising a inner tube (10) having a skirt (13), a shoulder (12) and an inner neck (11) containing a inner opening (14), a metal tube having a skirt (25), a shoulder (24) and an outer neck (21), the two tubes being connected together at the necks (11 and 21) by a nozzle (30) comprising a base (34) and at least one outer skirt (35) that grips the two necks (11 and 21) together, wherein the nozzle (30) is provided with a inner skirt (31) the outer surface of which has an overall tapered profile such that when the nozzle (30) is forced downward said inner skirt (31) causes the circumferences of the central parts of the necks (11 and 21) to expand and the ends of said necks to flare.

2. Double-walled tube (1) of claim 1 wherein play exists between the inner surface (38) of base (34) of the nozzle (30) and the edges (18 and 28) of the inner tubes (10) and the outer tubes (20).

3. Double-walled tube (1) claim 1 wherein the inner neck (11) is a hollow cylinder with a height/thickness ratio lower than 10.

4. Double-walled tube (1) of claim 1 wherein the nozzle (30) comprises a thread (41) on the outer surface of outer skirt (35) that is intended to connect a seal by screwing and anti-rotation means (42) on the inner surface of the outer skirt that match the anti-rotation means (22) located on the outer surface of outer neck (21).

5. Double-walled tube (1) of claim 1 wherein the outer neck (21) and the outer skirt (35) of the nozzle (30) are provided with matching snap-on means (23 and 37).

6. Double-walled tube (1) of claim 1 wherein the inner skirt (31) of nozzle (30) has an outer surface in three sections, the central part being cylindrical, the other two being tapered.

7. Double-walled tube (1) of claim 1 wherein the end of outer neck (21) is brought to stop against the inner surface of outer skirt (35) of nozzle (30).

8. Double-walled tube (1) of claim 1 wherein the inner neck (11) is made of a substance that is less hard and less stiff than the outer neck (21) and the inner skirt (31) of nozzle (30).

9. Double-walled tube (1) of claim 8 wherein the inner neck (11) is made of low-density polyethylene, the outer neck (21) of annealed aluminum and the inner skirt (31) of nozzle (30) of polypropylene.

10. Double-walled tube (1) of claim 1 wherein the end of outer neck (21) is generally thinned to a thickness equal to half that of the inner neck (11).

11. Double-walled tube (1) of claim 1 wherein the inner skirt (31) of nozzle (30) has a greater diameter in the cylindrical section than the original diameter of inner opening (14), the relative difference being between 3 and 8%.

12. Nozzle (30), that is intended to be fitted in the double-walled tube of claim 1, comprises a base (34) and an outer skirt (35), is wherein it comprises a inner skirt (31), fastened to its base (34), the profile of the outer surface of which is generally tapered, the open end (39) of the inner skirt (31) being directed towards the apex of the cone.

13. Nozzle (30) of claim 12 wherein the inner skirt (31) has an inner surface that is cylindrical and an outer surface in three sections, the central part being cylindrical, the other two being tapered.

* * * * *